US007752781B2

(12) United States Patent
Riedlberger et al.

(10) Patent No.: US 7,752,781 B2
(45) Date of Patent: Jul. 13, 2010

(54) CENTRING DEVICE FOR QUICK-CHANGE DEVICES

(76) Inventors: Robert Riedlberger, c/o Eulenthaler Str. 14, 85302 Singenbach (DE); Markus Riedlberger, c/o Eulenthaler Str. 14, 85302 Singenbach (DE)

( * ) Notice: Subject to any disclaimer, the term of this patent is extended or adjusted under 35 U.S.C. 154(b) by 0 days.

(21) Appl. No.: 12/095,043

(22) PCT Filed: Oct. 12, 2006

(86) PCT No.: PCT/DE2006/001784

§ 371 (c)(1),
(2), (4) Date: Sep. 25, 2008

(87) PCT Pub. No.: WO2007/059721

PCT Pub. Date: May 31, 2007

(65) Prior Publication Data

US 2009/0193691 A1 Aug. 6, 2009

(30) Foreign Application Priority Data

Nov. 28, 2005 (DE) ..... 10 2005 056 505

(51) Int. Cl.
*E02F 3/28* (2006.01)

(52) U.S. Cl. ..... 37/468; 414/723

(58) Field of Classification Search ..... 37/468, 37/403–410; 414/723, 912; 403/409.1, 328, 403/322.4, 322.1, 321; 411/412, 413
See application file for complete search history.

(56) References Cited

U.S. PATENT DOCUMENTS 5,890,871 A * 4/1999 Woerman ..... 414/723

(Continued)

FOREIGN PATENT DOCUMENTS

EP 0 704 577 A1 4/1996

(Continued)

OTHER PUBLICATIONS

PCT, "Written Opinion of the International Searching Authority", pp. 1-6, Completion Date: Jan. 3, 2007.

*Primary Examiner*—Robert E Pezzuto
(74) *Attorney, Agent, or Firm*—John A. Merecki; Hoffman Warnick LLC

(57) ABSTRACT

A quick-change device in which the arrangement of centring discs and of control plates prevents jamming during the insertion operation. In accordance with an embodiment, the quick change device includes: catch bolts; centring disks fixed to the quick-change device transverse to an axis of the catch bolts, each centring disk having a circumferential outer boundary line which is at a variable distance from the axis of the catch bolts; and control plates fixed to a tool holder on a counterpart of the quick-change device, the tool holder comprising catch hooks for engaging the catch bolts during an insertion process of the catch bolts into the catch hooks of the tool holder, the control plates engaging a movement-space of the centring disks during the insertion process, wherein the circumferential outer boundary line of each centring disk moves along a surface of a corresponding one of the control plates during the insertion process. The shape and an arrangement of the centring disks relative to the control plates is chosen such that a complete force or positive closure of the quick-change device during rotation about the catch bolts is only possible when the catch bolts have arrived in a lowest position in the catch hooks.

8 Claims, 2 Drawing Sheets

U.S. PATENT DOCUMENTS

| | | | | |
|---|---|---|---|---|
| 6,123,501 | A | 9/2000 | Pisco | |
| 6,233,852 | B1 * | 5/2001 | Pemberton | 37/468 |
| 6,487,800 | B1 * | 12/2002 | Evans et al. | 37/468 |

FOREIGN PATENT DOCUMENTS

| | | | |
|---|---|---|---|
| WO | WO 01/83893 | A1 | 11/2001 |
| WO | WO 2007/059721 | A1 | 5/2007 |

* cited by examiner

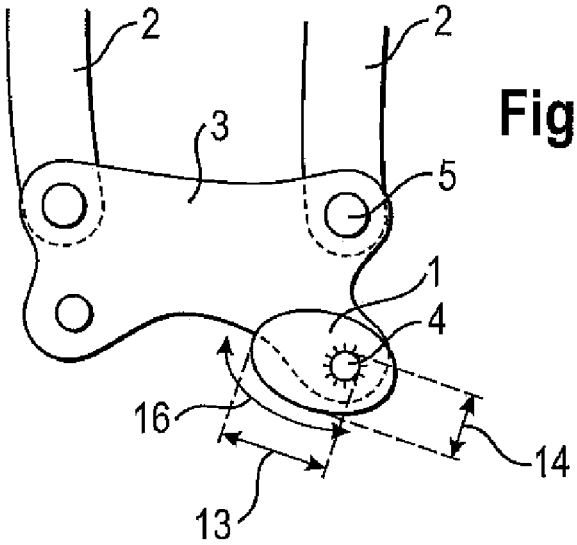
Fig. 1
Fig. 2
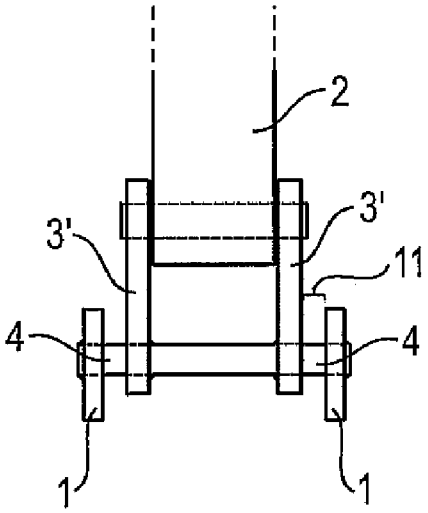
Fig. 3
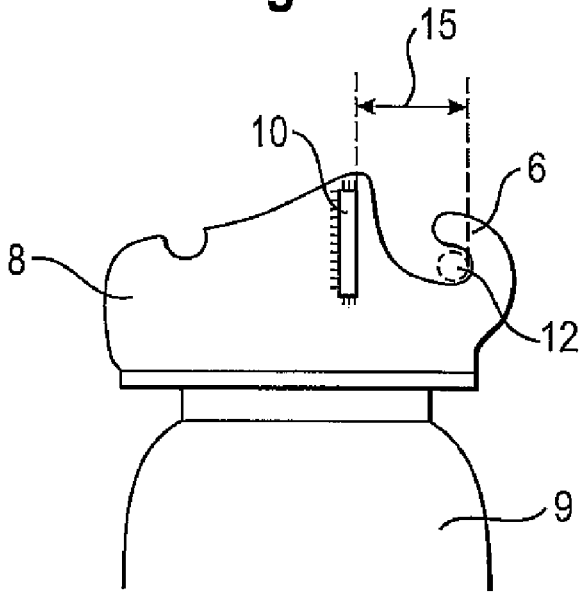
Fig. 4
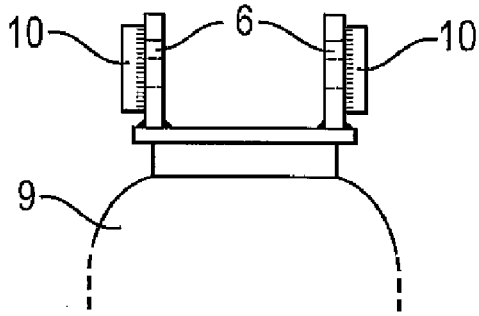

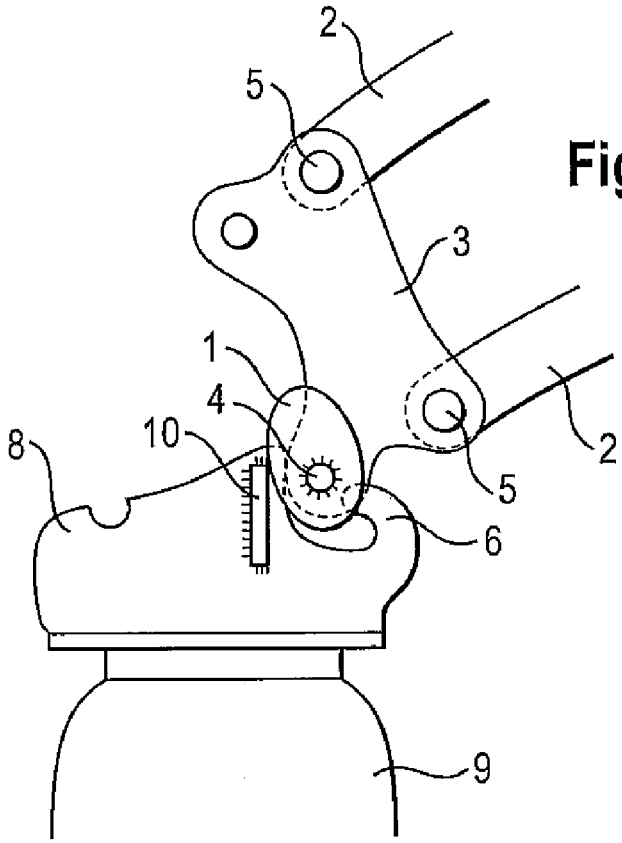
Fig. 5
Fig. 6
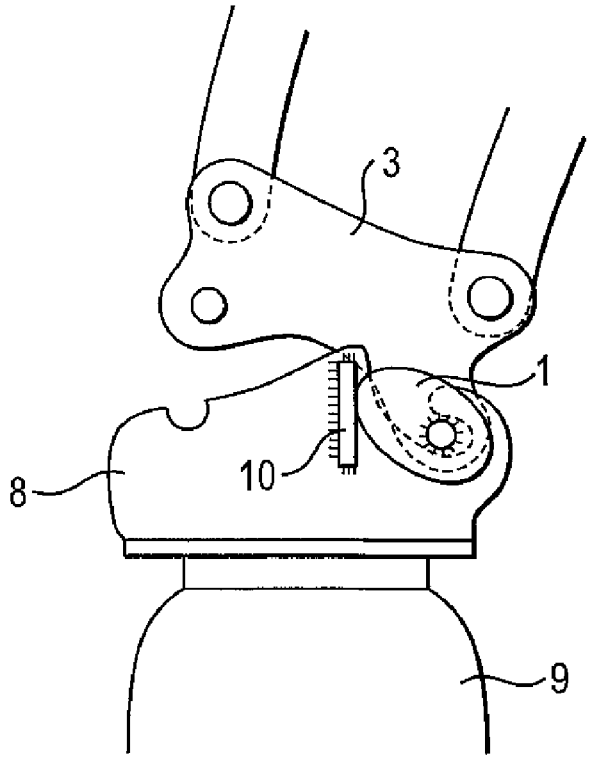
Fig. 7
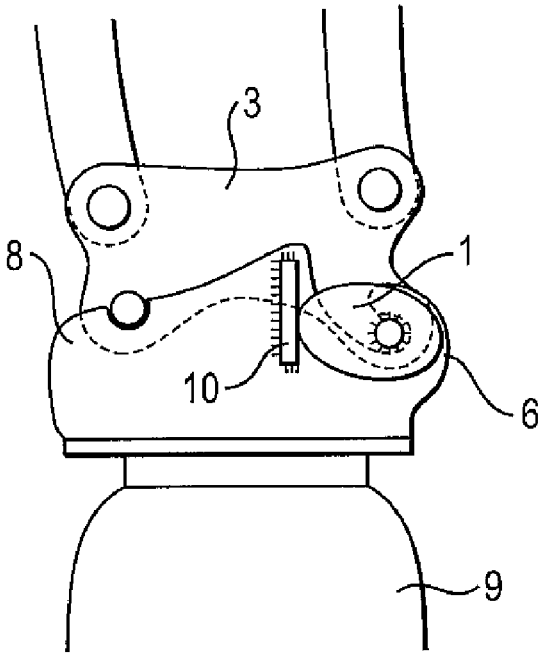

CENTRING DEVICE FOR QUICK-CHANGE DEVICES

FIELD OF THE INVENTION

The invention relates to a device for centring, guiding or forced guiding of the tool to be connected during the process of coupling to the carrier implement.

RELATED ART

For both stationary and non-stationary tasks it is necessary to change tools on implements so that it is possible to fulfill different tasks using the same basic implement. These can e.g. be agricultural implements, such as tractors or machines, to which it is necessary to fix different tools for soil preparation or for harvesting purposes.

Much the same applies regarding construction machines to which, as a function of the characteristics of the building site or the nature of the task, different digging or excavating tools must be fixed to the same carrier implement or excavator in order to be able to rapidly and economically perform the work.

For this purpose quick-change devices have been developed with which it is possible to rapidly and easily replace tools and mounted equipment without using human force and without the implement driver having to leave his machine.

In the case of construction machines such tools needing to be replaced can e.g. be different shovels, grippers, soil compaction vibrators, vibrating plates, crane means and other soil preparation or processing equipment.

DE 196 07 896 and DE 103 35 667 describe quick-change devices in which a fixing part is fixed to the carrier implement or excavator shaft or handle and which is connected to a matching counterpart located on the tool to be connected.

It is common to such implements that different catch bolts are fixed to one part and there are corresponding catch hooks on the counterpart.

Tool changing takes place in such a way that a tool is deposited by releasing the catch bolt from the catch hook and then the new tool is brought into a position suitable for insertion using the movable excavator handle on whose end the catch bolts are located.

For this purpose the catch bolts are inserted in the catch hooks of the tools and the tool is drawn up to shoved away from or optionally turned with respect to the implement. If both catch bolts are in the correct end position, i.e. completely in the lowest point of the catch hooks, the two parts of the quick-change coupling can be completely brought together about said fulcrum. Only now can there be a frictional connection of the two parts by using further parts such as bolts or detents, so that the two parts remain together.

The quick-change device only brings about frictional connections, such as e.g. the fixing of a backhoe to an excavator. If the mounted tools are movable devices or equipment driven by motors, it is also necessary to interconnect hose lines or cables in order to supply the drive with power or control the device. This should also take place fully automatically for convenience purposes.

In this case it is particularly important that on hooking in the tool the catch bolts do not tilt or hook together in the catch hooks due to skewing. Unfortunately in the case of the prior art quick-change devices this tilting risk exists to a significant extent and can lead to pronounced wear or to damage to the quick-change device.

There is in particular a high damage risk if on the tool, apart from the frictional connection, it is also necessary to interconnect cables or hoses. For this purpose several line couplings are fixed in the interior or exterior of the fixing element for the tools on the carrier implement or excavator handle and also to the tool holder with the tool to be connected.

If the catch bolts are not completely and uniformly inserted for both catch hooks and the two fixing elements are moved towards one another for the closing process, it can arise that the corresponding coupling elements do not sufficiently precisely face one another and therefore on bringing onto one another the line couplings can be damaged or destroyed.

This is of major importance when not only simple, unprotected couplings have to be interconnected, but instead particularly dirt and dust-protected couplings, as described in EP 0 918 186. As here the protective covers already open during the approach of the lying coupling elements of the lines, a tilting of the catch bolts and therefore a skewing of parts of the quick-change device can lead to damage of the couplings.

SUMMARY OF THE INVENTION

The object of the invention is to prevent tilting or skewing of the catch bolts in the catch hooks, so as to avoid damage during the coupling process.

The object is achieved by the corresponding features of the main claim.

BRIEF DESCRIPTION OF THE DRAWINGS

The invention is explained in detail relative to FIGS. 1 to 7.

FIG. 1 shows in exemplified manner a side view of the fixing element 3 of a quick-change device fixed to the carrier implement or excavator handle 2.

FIG. 2 shows the view of FIG. 1 rotated by 90°.

FIG. 3 shows the tool holder 8 or the counterpart to fixing element 3, which is located on tool 9 to be replaced.

FIG. 4 shows the view of FIG. 3 turned by 90°.

FIG. 5 shows the position of the inventive centring disk 1 and the associated control plate 10 at the start of the insertion process of catch bolts 4 in catch hooks 6.

FIG. 6 shows the position-during insertion, premature turning or twisting being prevented by the inventive centring disk 1.

FIG. 7 shows the position of the inventive centring disk 1 at the end of the insertion process and in the completely collapsed or folded state of the quick-change device.

DETAILED DESCRIPTION OF THE INVENTION

Tilting of the catch bolts during insertion into the catch hooks 6 is prevented by the arrangement of the inventive centring disks 1 on the catch bolts 4. The spacing 11 thereof from the side parts 3' of fixing element 3 being at least as large as the greatest plate thickness of the catch hook 6 on the tool.

At least in part in the contact area to the catch hook 6, the centring disks 1 are preferably planar or slightly rounded or even concave, so that the catch hooks 6 can easily pass between the centring disks 1.

The shape of the centring disk 1 is chosen in such a way that the outer boundary line 16 is at a different distance from the centre of the catch bolt 4. Preferably the boundary line 16 is curved, but can also be angular or straight. It is important that it runs at a different distance from the axis of catch bolt 4.

Preferred shapes for the centring disk 1 are circular, elliptical or oval or polygons comparable to said shapes.

If the circular shape is used the centring disk 1 is eccentrically fixed to catch bolt 4. To guarantee the function of centring disk 1, it is in principle only necessary to have a partial surface provided with the partial area of the boundary line 16 of centring disk 1.

In addition to the centring disk 1, to the counterpart to the fixing element 3, i.e. to the tool holder 8 with catch hooks 6, is frictionally fixed a control plate 10 along which the centring disk 1 moves during insertion. In that case the circumferential line area 16 of centring disk 1 moves in partly rotating, rolling or sliding manner along the surface of control plate 10 facing the catch hook 6.

The dimensions and arrangement of centring disk 1 on catch bolt 4 are selected in such a way that the fixing element 3 can only then be rotated about catch bolt 4 in a complete manner about the axis of catch hook 6 of tool holder 8 if the catch bolt 4 rests in the lowest position 12 of catch hook 6.

Catch bolt 4 is in this way eccentrically positioned in centring disk 1, the dimension 13 being equal to or greater than the hook spacing 15 relative to control plate 10 and dimension 14 relative to catch bolt 4 is smaller than dimension 13 and particularly dimension 15.

If catch bolt 4 has not reached the lowest position 12, the circumferential line 16 of centring disk 1 rest on control plate 10 and this prevents that by rotating about the axis of catch bolt 4 the fixing part 3 can further approach the tool holder 8. This situation is shown in FIG. 6. Thus, hydraulic couplings, which are e.g. located in the interior of fixing element 3, are also prevented from moving towards one another in a skewed state. Thus, damage to the associated coupling pieces is prevented.

The control plate 10 preferably comprises a projecting steel element, e.g. with a rectangular steel cross-section, which projects over the lateral wall surface of tool holder 8. The height is chosen such that at least with part of its plate thickness the centring disks 1 come to rest on control plate 10.

Preferably the contact surface of steel plate 10 is straight and planar. However, it can also be advantageous to concavely or convexly curve the contact surface.

The control plates can then also be flame cut parts. The control plates 10 are fixed by welding or screwing. For easy guidance during insertion it is appropriate to place the control plates 10 and centring disks 1 on both sides of the quick-change devices.

Centring during insertion is brought about in that the centring hooks 6 are guided in parallel in the gap 11 and also in that through the symmetrical arrangement of two centring disks 1 and two control plates 10 there is a type of "rolling up" or "sliding" of the centring disks 1 along the control plates 10.

With regards to tool holder 8, up to the complete closure of the quick-change device, the centring disk 1 roughly makes a quarter turn along the boundary line 16 of centring disk 1.

The catch hooks 6 can be fixed both to the carrier implement or excavator, or also to the tool. The catch bolts 4 must then in each case be fitted to the counterpart.

The invention claimed is:

1. Quick-change device for fixing and forced guiding during an automatic frictional connection of tools to carrier implements and excavators, comprising:

catch bolts;

centring disks fixed to the quick-change device transverse to an axis of the catch bolts, each centring disk having a circumferential outer boundary line which is at a variable distance from the axis of the catch bolts; and control plates fixed to a tool holder on a counterpart of the quick-change device, the tool holder comprising catch hooks for engaging the catch bolts during an insertion process of the catch bolts into the catch hooks of the tool holder, the control plates engaging a movement-space of the centring disks during the insertion process, wherein the circumferential outer boundary line of each centring disk moves along a surface of a corresponding one of the control plates during the insertion process;

wherein a shape and an arrangement of the centring disks relative to the control plates is chosen such that a complete force or positive closure of the quick-change device during rotation about the catch bolts is only possible when the catch bolts have arrived in a lowest position in the catch hooks.

2. Quick-change device according to claim 1, wherein, in a vicinity of the circumferential outer boundary line, the centring disks have a dimension relative to the catch bolts which is equal to or greater than a dimension assumed by the catch bolts (4) in the lowest position in the catch hooks relative to the control plates and a smallest spacing dimension of the circumferential outer boundary line (16) from the catch bolts is smaller than the dimension assumed by the catch bolts in the lowest position in the catch hooks.

3. Quick-change device according to claim 1, wherein the centring disks are shaped as ellipses, ovals, polygons or eccentrically fixed circular disks or are formed by parts of these shapes.

4. Quick-change device according to claim 1, wherein each centring disk is fixed at a distance from a side plate of a fixing element of the quick-change device, which roughly corresponds to a greatest plate thickness of each catch hook.

5. Quick-change device according to claim 1, wherein the centring disks are connected frictionally to the catch bolts or a comparable fulcrum by welding, pressing on, shrinking on or screwing.

6. Quick-change device according to claim 1, wherein the control plates are straight or curved sheet metal strips or flame cut parts, which are fixed by welding, screwing or plugging to the tool holder or the control plates are formed on the tool holder.

7. Quick-change device according to claim 1, wherein the catch bolts with the centring disks are either located on a fixing element of an excavator handle or on the tool holder, and wherein the catch hooks with the control plates are located in each case on a corresponding counterpart.

8. Quick-change device according to claim 1, wherein, at least on the surface on which the centring disks come into contact with the catch hooks during insertion, the centring disks are partly rounded or concave-planar.

* * * * *